United States Patent [19]

Henriksson et al.

[11] Patent Number: 4,537,655

[45] Date of Patent: Aug. 27, 1985

[54] PROCESS FOR PRODUCING AND FLASH DRYING HIGH YIELD MECHANICAL CELLULOSE PULP WITH STEAM AND CONDENSATE RECYCLE

[75] Inventors: Sven-Erik D. Henriksson, North Vancouver, Canada; Bo A. Ahrel, Frövi, Sweden; Claes G. S. Svensson, Kungälv, Sweden; Torsten A. H. Franzen, Domsjö, Sweden

[73] Assignee: MoDo-Chemetics AB, Ornskoldsvik, Sweden

[21] Appl. No.: 490,597

[22] Filed: May 2, 1983

[30] Foreign Application Priority Data

May 7, 1982 [SE] Sweden ..... 8202868

[51] Int. Cl.[3] ..... D21C 1/12; D21C 1/16

[52] U.S. Cl. ..... 162/23; 162/28; 162/46; 162/47

[58] Field of Search ..... 162/47, 68, 23, 24, 162/25, 28, 83, 84, 76, 19, 46, 90, 17; 241/28

[56] References Cited

U.S. PATENT DOCUMENTS

| | | | |
|---|---|---|---|
| 2,826,478 | 3/1958 | Schucker | 162/76 |
| 3,871,951 | 3/1975 | Drew | 162/68 |
| 4,043,049 | 8/1977 | Hedstrom | 34/10 |
| 4,207,139 | 6/1980 | Haikkala et al. | 162/47 |
| 4,231,842 | 11/1980 | Ojala | 162/47 |
| 4,259,148 | 3/1981 | Beath et al. | 162/68 |
| 4,326,913 | 4/1982 | Mattsson | 162/47 |
| 4,357,208 | 11/1982 | Peterson et al. | 162/23 |
| 4,421,595 | 12/1983 | Huusari | 162/47 |
| 4,426,258 | 1/1984 | Browning | 162/23 |

*Primary Examiner*—Steve Alvo

[57] ABSTRACT

A process is provided for inexpensively producing high yield mechanical cellulose pulp having good paper properties, which comprises preheating particulate lignocellulosic material; defibrating the preheated material under a superatmospheric steam pressure within the range from about 2 to about 4.5 bar above atmospheric pressure in a disc refiner under conditions such that steam is generated during the defibration; continuing the defibration until a cellulose pulp is obtained having a freeness within the range from about 300 to about 700 ml CSF; flash drying the defibrated cellulose pulp while maintaining a superatmospheric steam pressure within the said range during the drying; withdrawing steam generated during the defibration and passing it in indirect heat exchange with steam utilized in the flash drying, so as to utilize in the drying at least 30% of the heat content thereof; and then removing and baling the flash-dried cellulose pulp. Water vapor produced in the flash dryer is condensed and recycled to the disc refiner.

7 Claims, 4 Drawing Figures

Figures 1, 2:
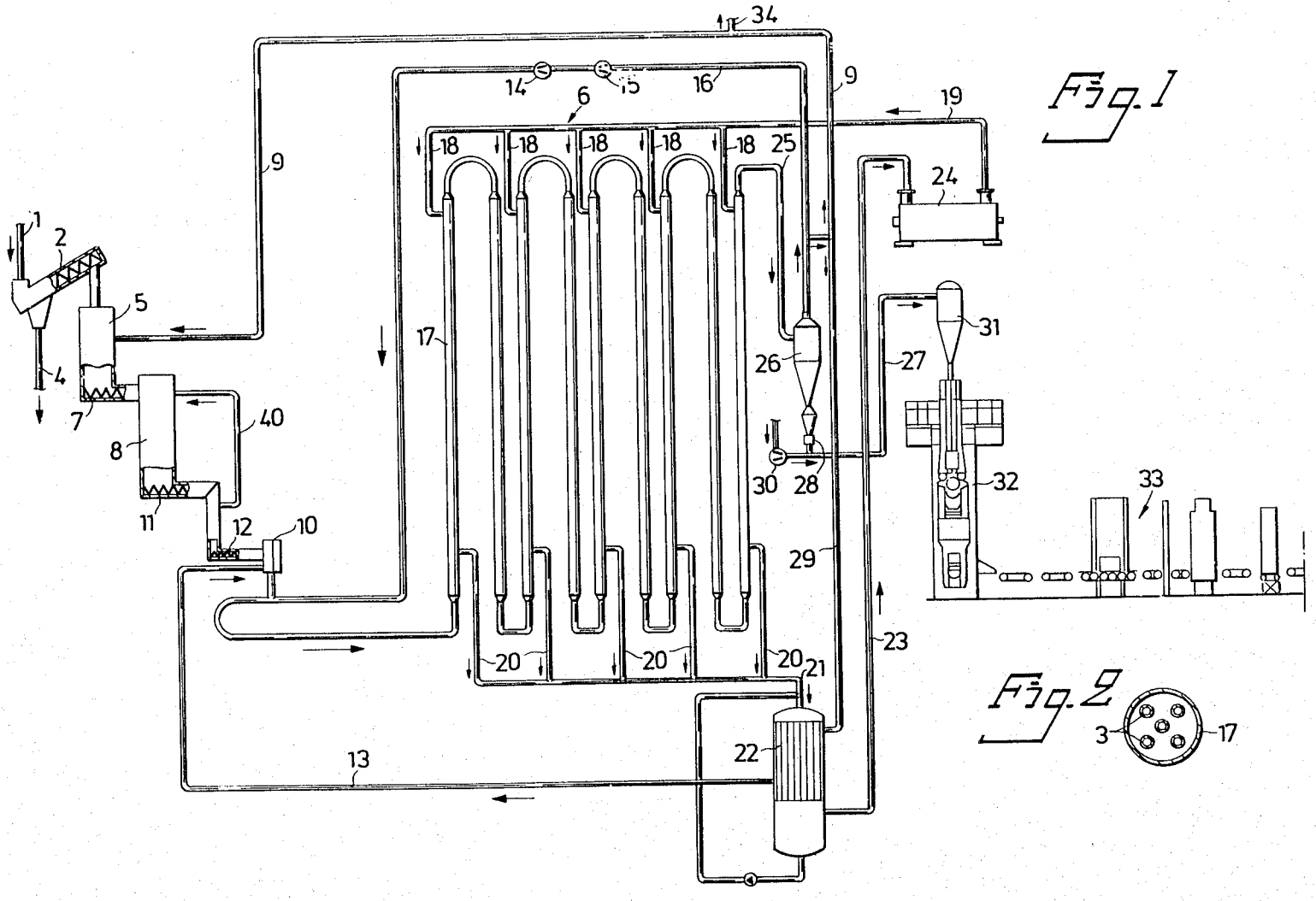

1
2
3
4
5
6
7
8
9
10
11
12
13
14
15
16
17
18
19
20
21
22
23
24
25
26
27
28
29
30
31
32
33
34
40

1
2
4
5
7
8
9
9
10
11
12
13
14
15
16
17
18
18
18
18
18
18
19
20
20
20
21
22
23
24
25
26
27
28
30
31
32
33
34
37
38
39
40
6

PROCESS FOR PRODUCING AND FLASH DRYING HIGH YIELD MECHANICAL CELLULOSE PULP WITH STEAM AND CONDENSATE RECYCLE

Cellulose pulp for use in paper mills is prepared in high yields, i.e., above 80%, by mechanical defibration, for example, by grinding wood logs or chips in a pocket grinder, or by defibrating wood chips in disc refiners. Mechanical defibration is optionally done under superatmospheric pressure, and optionally after pretreatment by heating with or without added chemicals. Subsequently, the cellulose pulp can be bleached, and can be dried in, for example, a flash dryer, which may be operated at a superatmospheric overpressure, after which the dried pulp is baled and shipped to the paper mill, which can be but only in exceptional cases is an integral part of the pulping mill, and located on the same mill site.

The starting material for the pulp mill is either wood logs or wood chips, both of which are transported only at high cost using expensive special loading and unloading apparatus. If there be no source of wood log or chips near the pulp mill, timber or chips must be transported there by boat, and hence the pulp mill must be located at or near a port or harbor. The high cost for loading and unloading and for transport is in part due to the fact that half of the weight of the wood is water. For example, at present day prices, the cost of transporting wood chips from Brazil to Europe is $158 per yearly day-ton in the pulp mill, of which the actual transportation costs are $108. Thus, at the current $350 per ton selling price of thermomechanical pulp in Europe the cost of the raw material alone constitutes nearly 50% of the selling price.

Since the manufacture of high-yield mechanical paper pulps requires a particularly high energy input, there is a great need for an inexpensive paper pulp making process, particularly in view of rising energy costs. It should be noted that the cost of electricity is normally low in areas such as Brazil where wood is plentiful, and normally high in areas such as Europe where it is not.

According to the present invention, a solution to the problem is provided by a process for inexpensively producing high-yield mechanical pulp having good paper properties, which comprises (1) preheating particulate lignocellulosic material;

(2) defibrating the preheated material under a steam pressure within the range from about 2 to about 4.5 bar above atmospheric pressure under conditions such that steam is generated during the difibration;

(3) continuing the defibration until a cellulose pulp is obtained having a freeness within the range from about 300 to about 700 ml CSF;

(4) flash drying the defibrated cellulose pulp while maintaining a superatmospheric steam pressure within the said range during the drying;

(5) withdrawing steam generated during the defibration and passing it in indirect heat exchange with steam utilized in the flash drying, so as to utilize in the drying at least 30% of the heat content thereof; and then (6) removing and baling the flash-dried cellulose pulp.

It has surprisingly been found possible to connect the outlet of a pressurized disc refiner directly to the inlet of a pressurized flash dryer, so that the defibrated cellulose pulp from the disc refiner passes directly while maintaining a superatmospheric steam pressure within the above range in both the refiner and the dryer. This makes it possible to improve considerably the heat-economy of the pulping process, by recycling the heat content of the steam generated in, and derived from the cooling water supplied to, the disc refiner, the water being converted to steam by the frictional work carried out in the refiner. A major part of the electrical energy supplied to the disc refiner is consumed in this conversion of water to steam while only a minor part of the energy input is consumed in the actual work of defibration.

The process of the present invention inexpensively produces mechanical cellulose pulp having a high yield, i.e. a yield of 80% or more, of all types. Examples of such mechanical pulps include refiner pulps, chemimechanical pulp, and thermomechanical pulp.

Thus, the process according to the invention can be used for the preparation of thermomechanical pulp. Approximately 50 to 60% of the steam generated in the defibrator stage is suitably returned to the flash drying stage, while the remainder can be used for other purposes, such as the production of hot water, the pre-heating of wood chips, the drying of bark, or for other heating purposes not a part of the pulping process.

The process according to the invention can also be applied to the manufacture of chemimechanical pulp, i.e. in those high-yield processes in which prior to being defibrated, and optionally heated, the wood chips are mixed with chemicals, such as sodium bisulphite, sodium hydroxide, sodium carbonate, sodium bicarbonate, nitric acid, oxides of nitrogen, etc. When sodium bisulphite is used, the pH of the chip-preimpregnation stage is suitably held at about 8 to 9.

A suitable flash dryer which operates under a superatmospheric steam pressure and with indirect heat exchange for heating the steam is described in U.S. Pat. No. 4,043,049, patented Aug. 23, 1977 to Bengt Olof Arvid Hedstrom, as shown in FIGS. 1 to 4.

According to a particularly suitable embodiment of the invention illustrated in FIGS. 1 and 2, the washed and pre-heated wood chips are defibrated in a disc refiner which operates under a superatmospheric steam pressure, the outlet of which is directly connected to a steam flash dryer. The impure gases generated by evaporation in the steam flash dryer are separated in a cyclone separator and then condensed in a re-boiler, and returned as cooling water to the disc refiner, while the pure water formed by condensation of the heating steam under high pressure in the steam flash dryer is vaporized in a reboiler and converted to high-pressure steam in a steam compressor, from which it is returned to the steam dryer. In this embodiment, it is also particularly suitable to use part of the impure gases formed by evaporation in the steam dryer for pre-heating incoming wood chips, subsequent to separating the gases in a cyclone separator.

Figure 4:
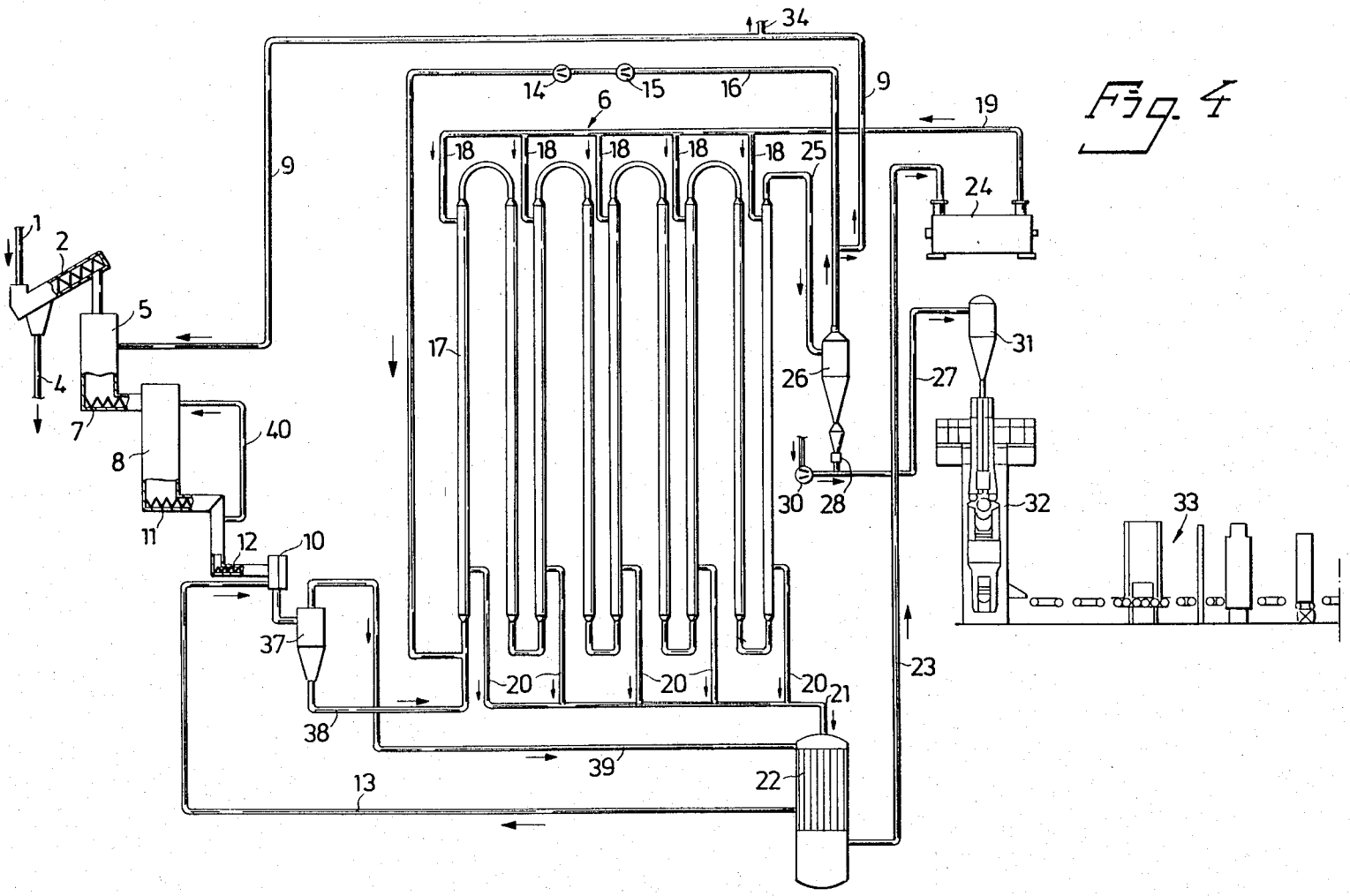

According to another suitable embodiment of the invention, illustrated in FIG. 4, washed and pre-heated wood chips are defibrated in a disc refiner operating under superatmospheric steam pressure with the outlet of the disc refiner directly connected to a cyclone whose outlet is, in turn, connected directly to the steam flash dryer. Impure gases separated in the cyclone are condensed in a re-boiler, and returned to the disc refiner, while the pure water formed by condensation of the heating steam of the steam dryer is vaporized in the re-boiler, and converted to high-pressure steam in a steam compressor, and then returned to the steam flash dryer.

The process of the invention makes it possible to produce an acceptable high-yield cellulose pulp in a timber-rich area, such as Brazil, at a cost which, including the transportation of bales to a timber poor area, such as Europe, which is still approximately 40% less than the selling price for high-yield pulp produced in the timber poor area. Thus, the problem of the high cost of transport of wood containing 50% water, and the need for locating the pulp mill in the vicinity of harbors equipped with expensive off-loading and loading apparatus, has been substantially overcome. The paper mill can get an acceptable pulp suited to its requirements at a much lower cost than the present pulp produced within the timber-poor area.

Figure 3:
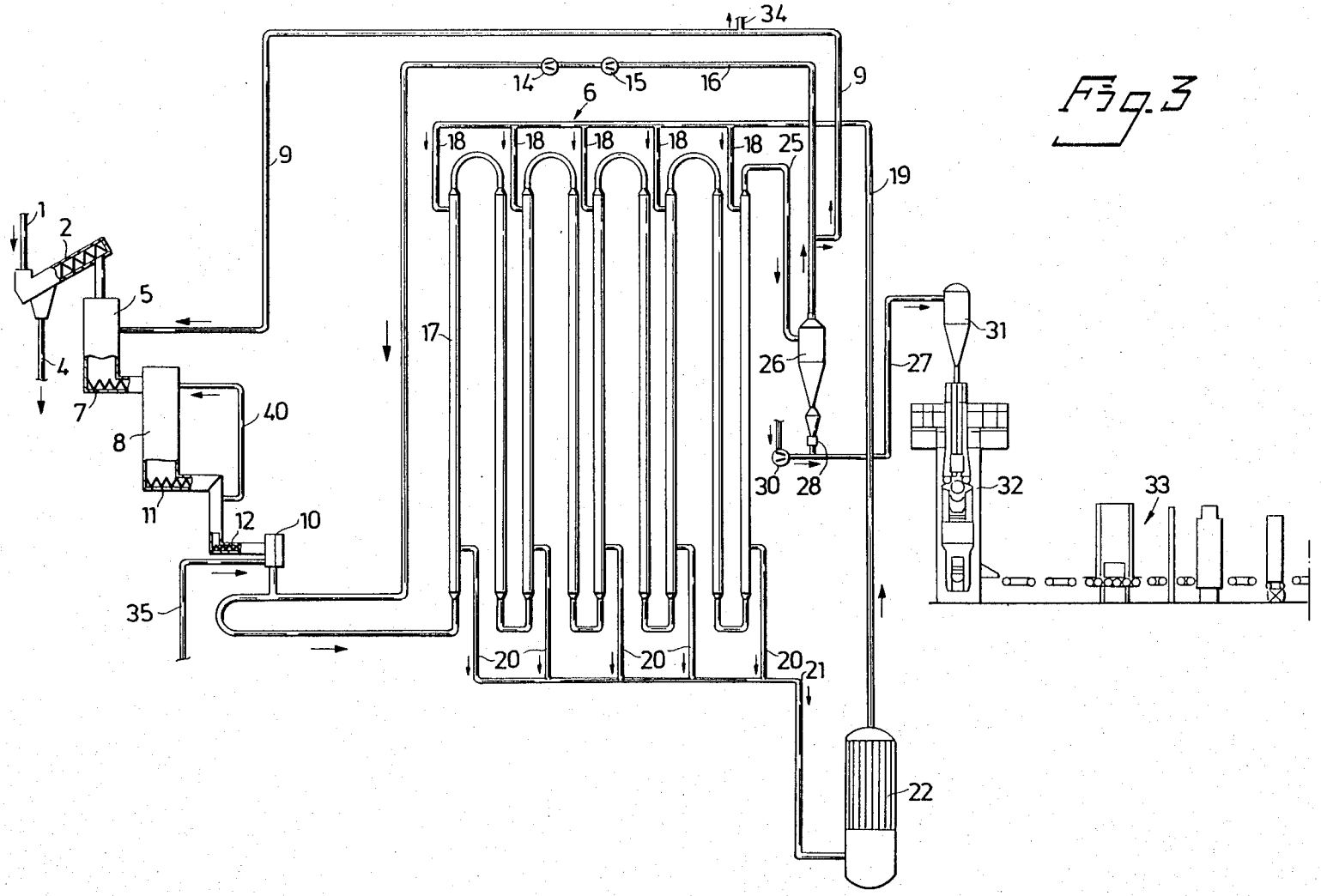

The process of the invention is illustrated in the drawings by way of preferred embodiments, of which FIG. 1 illustrates schematically a pulp mill installation in which the method according to the invention can be applied in the manufacture of thermomechanical pulp, FIG. 2 is a detail view in cross-section of the steam flash dryer tubes of the pulp mill illustrated in FIG. 1;

FIG. 3 illustrates a slightly modified pulp mill for producing chemimechanical pulp; and FIG. 4 illustrates a modified pulp mill for producing thermomechanical pulp.

The drawings are described together with preferred embodiments of the method according to the invention in the following Examples.

EXAMPLE 1

Production of thermomechanical pulp using the pulp mill of FIGS. 1 and 2

Pre-heated and washed pine chips freed from sand were pumped through the line 1 to a screw dewaterer 2, the water separating by gravity being conducted away through the line 4. The chips were carried by the screw to the steam vessel 5, which was heated with secondary steam recycled from the steam dryer 6, introduced through the line 9. The preheated chips then passed from the vessel 5 into the pressurized preheater 8, via the screw feeder 7. The preheater had a steam pressure of about 3 bar generated by the steam formed in the disc refiner 10, and passed to the preheater 8 via the line 40. The chips from the preheater were carried via the screw feeder 12 to the disc refiner 10, where the chips were defibrated with an energy input of about 1000 kWh per ton 100% output pulp to a freeness of about 600 ml CSF. Impure, hot condensation water at 120° C. was charged to the disc refiner through the line 13, for cooling and dilution of the pulp slurry.

While maintaining the steam pressure, the pulp was blown by fans 14 and 15 directly from the disc refiner into the steam flash dryer 6 through the line 16. In this manner, approximately 1.3 tons of steam per ton of dry pulp were introduced with the pulp into the steam flash dryer. The steam flash dryer 6 comprised a plurality of inner tubes 3 (see FIG. 2) through which the pulp was transported while suspended in steam, the pipes being surrounded by a casing 17. The pulp was held in the steam flash dryer for about 20 seconds. The temperature of the pulp suspension in the tubes was the same as that in the disc refiner, i.e. about 130° C., and its pressure was about 3 bar.

Superheated drying steam at a pressure of 8 to 10 bar was introduced between the casing 17 and the tubes, the steam being supplied through the lines 18 extending from the header 19. As the pulp was transported through the steam dryer, heat was transferred from the superheated drying steam to the pulp suspension. This resulted in vaporization of the water contained in the moist pulp.

The drying steam was condensed and removed in the form of condensate water at about 160° C. through the line 20; the water was returned to the reboiler 22 through the collector line or header 21. The pure water condensate was converted in the reboiler 22 to fresh steam at a pressure of about 3 bar, and this fresh steam was passed through the line 23 to the steam compressor 24 for conversion to high-pressure steam at a pressure of 8 to 10 bar. The high-pressure steam was supplied to the steam dryer through the line 19. The pulp arriving from the steam dryer had a solids content of about 90% and a temperature of about 130° C., and was passed through the line 25 to the cyclone 26, where the pulp was separated from the steam and transferred to the line 27 via the valve feeder 28.

Steam having a pressure of about 3 bar passes from the cyclone 26 through the line 16. Part of this steam, corresponding to the amount of water evaporated from the pulp, was removed through the line 29 and returned to the reboiler 22, where it was condensed while converting the pure condensate water supplied through the line 21 to fresh steam, which was removed through the line 23. The condensed water contained some fiber residues and extractive substances, and was removed from the reboiler through the line 13 in the form of impure condensate, and returned to the disc refiner 10. The dry pulp from the cyclone 26 was blown by a fan 30 through the line 27 to a cyclone 31, and cooled to a temperature of 30° 1 to 40° C. Pulp departing from the cyclone 31 was transferred to a slab press 32, where it was pressed into bales, and packaged in the packaging plant 33.

Another part of the steam exiting from the cyclone 26 was passed through the line 9 to the preheater 5, for heating the incoming chips. Since there was a surplus of fresh steam, part of the steam flowing through the line 9 was removed through the line 34, and used to satisfy other requirements in the pulp mill.

The paper pulp thus produced had a solids content of 90%, a freeness of 600 ml CSF, and a brightness of 59% ISO. The yield was 95%.

At a feed rate of 7.5 tons of bone dry wood chips per hour, with a water-content of 1.2 tons water at a temperature of 20° C. per ton of dry wood to the preheater 5, the energy input to the disc refiner was 1 MWh per ton of solids. Approximately 1 ton of water was introduced into the disc refiner 10 with each ton of dry pulp. The energy input to the steam compressor 24 was 115 kWh per ton of dry pulp, and the fans 14 and 15 of the steam dryer consumed 30 kWh per ton of dry pulp. The total energy consumed by the entire plant was about 1220 kWh per ton of dry pulp, which is very low, and of which 1.0 ton of steam per ton of dry pulp removed in the line 34 can be utilized for other purposes.

In the defibrating and drying plant there is vaporized about 2.4 tons of water per ton of dry pulp, to generate steam having a temperature of 130° C. and a pressure of 3 bar. In the reboiler 22, 1.4 tons of steam per ton of dry pulp at a pressure of about 8 bar was generated and returned to the steam dryer through the line 19, in accordance with the invention, which corresponds to about 1.42 tons of steam at a temperature of 130° C. and a pressure of 3 bar. Thus, 58% of the heat-content of the steam generated in the difibration stage and in the drying stage was returned to the flash drying stage, which explains the low energy-consumption achieved when practicing the method according to the invention. If it is assumed that the cost of chips in a timber-rich area such as Brazil is $50 per ton of bone dry pulp, the cost of producing pulp bales in accordance with the invention is $105 per ton of bone dry pulp. The cost of transporting the bales to a remote timber-poor area such as Europe is about $42 per ton of bone dry pulp, which means a manufacturers cost price is about $197 per ton of bone dry pulp, before delivery to a paper-making mill in the timber-poor area. If the paper manufacturer had, instead, chosen to import chips from a remote timber-rich area, he would have been faced with a cost of $50 for the chips, a cost of $108 for transportation, and a manufacturing cost of about $140 (higher price), i.e. a total cost of $298, all calculated per ton of dry pulp. Thus, the present invention results in a cost saving of about 34%.

EXAMPLE 2

Manufacture of chemimechanical pulp using the pulp mill of FIG. 3

In a chip-washing apparatus operating at high temperature (80° C.) (not shown in FIG. 3) the washing water was admixed with alkaline sodium sulphite solution, corresponding to 10 to 20 kg $SO_2$ per ton of bone-dry wood substance (pH 8.5). The washed and chemically impregnated wood chips, which comprised 70% aspen and 30% spruce, were introduced through the line 1 into the mill according to FIG. 3, which was the same as that of FIGS. 1 and 2, except that the thermocompressor 24 was replaced with a steam boiler 22 for burning bark, the outlet steam line of which was connected to the line 19. The lines 29 and 13 were also disconnected, and the fresh water was instead passed to the disc refiner through the line 35.

The chips were pumped through the line 1 to a screw dewaterer 2, the alkaline solution separating by gravity being conducted away through the line 4. The chips were carried by the screw to the steam vessel 5, which was heated with secondary steam recycled from the steam dryer 6, introduced through the line 9. The preheated chips then passed from the vessel 5 into the pressurized preheater 8, via the screw feeder 7. The preheater had a steam pressure of about 3 bar, generated by the steam formed in the disc refiner 10, and passed to the preheater 8 via the line 40. The chips from the preheater were carried via the screw feeder 12 to the disc refiner 10, where the chips were defibrated with an energy input of about 1900 kWh per ton 100% output pulp to a freeness of about 300 ml CSF. Impure, hot condensation water at 120° C. was charged to the disc refiner through the line 13, for cooling and dilution of the pulp slurry.

While maintaining the steam pressure, the pulp was blown by fans 14 and 15 directly from the disc refiner into the steam flash dryer 6 through the line 16. In this manner, approximately 1.3 tons of steam per ton of dry pulp were introduced with the pulp into the steam flash dryer. The steam flash dryer 6 comprised a plurality of inner tubes 3 (see FIG. 2) through which the pulp was transported while suspended in steam, the pipes being surrounded by a casing 17. The pulp was held in the steam flash dryer for about 20 seconds. The temperature of the pulp suspension in the tubes was the same as that in the disc refiner, i.e. about 130° C., and its pressure was about 3 bar.

Superheated drying steam at a pressure of 8 bar was introduced between the casing 17 and the tubes, the steam being supplied through the lines 18 extending from the header 19. As the pulp was transported through the steam dryer, heat was transferred from the superheated drying steam to the pulp suspension. This resulted in vaporization of the water contained in the moist pulp.

The drying steam was condensed and removed in the form of condensate water at about 160° C. through the line 20; the water was returned to the boiler 22 through the collector line or header 21. The pure water condensate was converted in the boiler 22 to fresh steam at a pressure of about 8 bar and a temperature of 170° C., and this fresh steam was passed through the line 19 to the steam dryer. The pulp arriving from the steam dryer had a solids content of about 84% and a temperature of about 130° C., and was passed through the line 25 to the cyclone 26, where the pulp was separated from the steam and transferred to the line 27 via the valve feeder 28.

Steam having a pressure of about 3 bar passes from the cyclone 26 through the line 16. The dry pulp from the cyclone 26 was blown by a fan 30 through the line 27 to a cyclone 31, and cooled to a temperature of 30° to 40° C. Pulp departing from the cyclone 31 was transferred to a slab press 32, where it was pressed into bales, and packaged in the packaging plant 33.

The steam exiting from the cyclone 26 was passed through the line 9 to the preheater 5, for heating the incoming chips. Since there was a surplus of fresh steam, the remaining part of the steam flowing through the line 9 was removed through the line 34, and used to satisfy other requirements in the pulp mill, and drying of bark in boiler 22.

3.8 tons of water per ton of dry pulp were vaporized in the defibrating and drying plant, to form steam at a temperature of about 130° C. and a pressure of about 3 bar. In the boiler 22, 1.3 tons of water per ton of dry pulp at a temperature of 170° C. and a pressure of 8 bar were generated and returned to the steam flash dryer through the line 19, in accordance with the invention, which corresponded to 1.32 tons of steam having a temperature of 130° C. and a pressure of 3 bar. Thus, 33% of the heat-content of the steam generated in the defibrator was returned to the drying stage. Of the 3.2 tons of steam having a temperature of 130° C. and a pressure of 3 bar that were removed through the line 34 per ton of dry pulp, 1.3 tons were used to dry bark in a bark dryer. The remaining steam was used to dry wood in a wood dryer. In this way 100% of the steam generated in the defibrator was reused in the process.

The chemimechanical paper pulp produced had a freeness of 300 ml CSF, a brightness of 64% ISO, a shives content of 0.2% and a solids content of 84%. The yield was 93%.

The results in this Example show that the method according to the invention can also be applied in the manufacture of more qualified chemimechanical pulp, and that the pulp so produced is much less expensive than corresponding pulp produced from imported chips.

EXAMPLE 3

Manufacture of thermomechanical pulp using the mill of FIG. 4

The pulp mill illustrated in FIG. 4 is substantially the same as that illustrated in FIG. 1, but with the difference that the pulp exiting from the defibrator 10 was passed to a cyclone 37 prior to entering the steam flash dryer 6 via a line 38. Steam departing from the cyclone was passed to the reboiler 22, through the line 39, and was removed from said reboiler through the line 13. The impure steam from the line 39 converted the condensate from line 21 in the reboiler 22 to pure steam, which was returned to the steam dryer through the line 23, the steam compressor 24 and the line 19.

Although it is possible in accordance with the invention to pass the steam directly from the line 39 to the steam flash dryer via the line 19, this will result in the disadvantage of impure steam, and unnecessarily large heat surfaces in the steam flash dryer, as a result of the low pressure. The pressure in the line 39 is about 3 bar and in the line 38 about 2 bar.

Preheated and washed pine chips freed from sand were pumped through the line 1 to a screw dewaterer 2, the water separating by gravity being conducted away through the line 4. The chips were carried by the screw to the steam vessel 5, which was heated with secondary steam recycled from the steam dryer 6, introduced through the line 9. The preheated chips then passed from the vessel 5 into the pressurized preheater 8, via the screw feeder 7. The preheater had a steam pressure of 4.5 bar generated by the steam formed in the disc refiner 10, and passed to the preheater 8 via the line 40. The chips from the preheater were carried via the screw feeder 12 to the disc refiner 10, where the chips were defibrated at a high pressure of 4.5 bar with an energy input of about 1000 kWh per ton 100% output pulp to a freeness of about 600 ml CSF. Impure, hot condensation water at 160° C. was charged to the disc refiner through the line 13, for cooling and dilution of the pulp.

While maintaining the steam pressure, the pulp was blown directly from the disc refiner into the cyclone 37 and from there through the line 38 into the steam flash dryer 6. In this manner, approximately 1.3 tons of steam per ton of dry pulp were introduced with the pulp into the steam flash dryer. The steam flash dryer 6 comprised a plurality of inner tubes 3 (see FIG. 2) through which the pulp was transported while suspended in steam, the pipes being surrounded by a casing 17. The pulp was held in the steam flash dryer for about 20 seconds. The temperature of the pulp suspension in the tubes was the same as that in the disc refiner, i.e. about 140° C., and its pressure was about 4.5 bar.

Superheated drying steam at a pressure of 8 bar was introduced between the casing 17 and the tubes, the steam being supplied through the lines 18 extending from the header 19. As the pulp was transported through the steam dryer, heat was transferred from the superheated drying steam to the pulp suspension. This resulted in vaporization of the water contained in the moist pulp.

The drying steam was condensed and removed in the form of condensate water at about 160° C. through the line 20; the water was returned to the reboiler 22 through the collector line or header 21. The pure water condensate was converted in the reboiler 22 to fresh steam at a pressure of about 4.5 bar, and this fresh steam was passed through the line 23 to the steam compressor 24 for conversion to high-pressure steam at a pressure of 8 bar. The high-pressure steam was supplied to the steam dryer through the line 19. The pulp arriving from the steam dryer had a solids content of about 90% and a temperature of about 140° C., and was passed through the line 25 to the cyclone 26, where the pulp was separated from the steam and transferred to the line 27 via the valve feeder 28.

Steam having a pressure of about 4.5 bar passes from the cyclone 26 through the line 16. The condensed water in line 21 contained some fiber residues and extractive substances, and was removed from the reboiler through the line 13 in the form of impure condensate, and returned to the disc refiner 10. The dry pulp from the cyclone 26 was blown by a fan 30 through the line 27 to a cyclone 31, and cooled to a temperature of 30° to 40° C. Pulp departing from the cyclone 31 was transferred to a slab press 32, where it was pressed into bales, and packaged in the packaging plant 33.

Another part of the steam exiting from the cyclone 26 was passed through the line 9 to the preheater 5, for heating the incoming chips. Since there was a surplus of fresh steam, part of the steam flowing through the line 9 was removed through the line 34, and used to satisfy other requirements in the pulp mill.

In the defibrating and drying plant there is vaporized about 2.4 tons of water per ton of dry pulp to generate steam having a temperature of 140° C. and a pressure of 4.5 bar. In the reboiler 22, 1.4 tons of steam per ton of dry pulp at a pressure of about 8 bar was generated and returned to the steam dryer through the line 19, in accordance with the invention which corresponds to about 1.42 tons of steam at a temperature of 140° C. and a pressure of 4.5 bar. Thus 58% of the heat-content of the steam generated in the defibration stage and in the drying stage was returned to the flash drying stage.

The paper pulp thus produced had a solids content of 90%, a freeness of 600 ml CSF, and a brightness of 54% ISO. The yield was 96%.

Having regard to the foregoing disclosure the following is claimed as the inventive and patentable embodiments thereof:

1. A process for inexpensively producing high yield mechanical cellulose pulp having good paper properties, which comprises (1) preheating particulate lignocellulosic material;

(2) difibrating the preheated material under a steam pressure within the range from about 2 to about 4.5 bar above atmospheric pressure in a disc refiner under conditions such that steam is generated during the defibration;

(3) continuing the defibration until a cellulose pulp is obtained having a freeness within the range from about 300 to about 700 ml CSF;

(4) flash drying the defibrated cellulose pulp in a steam-heated flash dryer while maintaining a superatmospheric steam pressure within the said range during the drying;

(5) withdrawing steam generated during the defibration and passing it in indirect heat exchange with steam utilized in the flash drying, so as to utilize in the drying at least 30% of the heat content thereof; and then (6) removing and baling the flash-dried cellulose pulp;

(7) separating water vapor produced by evaporation in the steam-heated flash dryer and condensing the water vapor to water;

(8) recycling the water condensate for cooling and dilution to the disc refiner;

(9) vaporizing water condensate from the heating steam of the steam-heated flash dryer converting it to high pressure steam; and then

(10) recycling the steam for heating to the steam-heated flash dryer.

2. A process according to claim 1 in which the lignocellulosic material is wood chips.

3. A process according to claim 1 in which part of the water vapor from the steam heated flash dryer is used for preheating wood chips.

4. A process according to claim 2 in which the outlet of the disc refiner being directly connected to a cyclone whose outlet is connected directly to the steam-heated flash dryer; and wherein the cyclone performs said separating and condensing.

5. A process according to claim 1 in which a digestion chemical is added to the wood chips during preheating.

6. A process according to claim 5 in which the digestion chemical is selected from the group consisting of sodium sulphite, sodium bicarbonate, sodium hydroxide and mixtures thereof.

7. A process according to claim 6 in which an aqueous solution of sodium sulphite is used having a pH within the range from 8 to 9.

* * * * *